US010056245B2

(12) United States Patent
Nilius

(10) Patent No.: US 10,056,245 B2
(45) Date of Patent: Aug. 21, 2018

(54) DC GAS DISCHARGE LAMP HAVING A THORIUM-FREE CATHODE

(71) Applicant: OSRAM GmbH, Munich (DE)

(72) Inventor: Maria Nilius, Berlin (DE)

(73) Assignee: OSRAM GMBH, Munich (DE)

( * ) Notice: Subject to any disclaimer, the term of this patent is extended or adjusted under 35 U.S.C. 154(b) by 3 days.

(21) Appl. No.: 15/276,826

(22) Filed: Sep. 27, 2016

(65) Prior Publication Data

US 2017/0092478 A1 Mar. 30, 2017

(30) Foreign Application Priority Data

Sep. 30, 2015 (DE) ..... 10 2015 218 878

(51) Int. Cl.
*H01J 61/073* (2006.01)
*H01J 61/86* (2006.01)

(52) U.S. Cl.
CPC ..... *H01J 61/0737* (2013.01); *H01J 61/0732* (2013.01); *H01J 61/0735* (2013.01); *H01J 61/86* (2013.01)

(58) Field of Classification Search
CPC ..... H01J 61/0737; H01J 61/0735; H01J 61/0732; H01J 61/86
See application file for complete search history.

(56) References Cited

U.S. PATENT DOCUMENTS

2005/0104521 A1 5/2005 Berndanner et al.
2009/0033200 A1* 2/2009 Aurongzeb ..... H01J 61/0732 313/326
2011/0260611 A1 10/2011 Kagebayashi et al.
2012/0062101 A1 3/2012 Winzek
2012/0181925 A1 7/2012 Arimoto et al.
2017/0062200 A1* 3/2017 Minayeva ..... H01J 1/15

FOREIGN PATENT DOCUMENTS

DE 102009021235 A1 11/2010
DE 102011016363 A1 10/2011
EP 1481418 B8 3/2012
(Continued)

OTHER PUBLICATIONS

German Search Report based on application No. 10 2015 218 878.7 (9 pages) dated May 18, 2016 (for reference purpose only).
(Continued)

*Primary Examiner* — Kevin Quarterman
(74) *Attorney, Agent, or Firm* — Viering Jentschura & Partner MBB

(57) ABSTRACT

A DC gas discharge lamp includes an anode and a cathode having a first cathode segment, which forms the surface of the cathode at least in a region of the cathode which faces the anode and has an arc attachment region, within which an arc burning between the cathode and the anode attaches during lamp operation as intended. The first cathode segment consists of tungsten with at least one emitter material for reducing the work function of electrons from the cathode. The cathode is embodied in a manner free of thorium. The at least one emitter material has a melting point of less than 3200 K. At least one part of the surface of the cathode outside the arc attachment region is formed by a diffusion barrier for the at least one emitter material.

20 Claims, 9 Drawing Sheets

(56) References Cited

FOREIGN PATENT DOCUMENTS

| | | | |
|---|---|---|---|
| WO | 2013113049 | A1 | 8/2013 |
| WO | 2014038423 | A1 | 3/2014 |
| WO | 2015128754 | A1 | 9/2015 |

OTHER PUBLICATIONS

Tanaka, M.: "In situ measurements of electrode work functions in fee-burning arcs during operation at atmospheric pressure", Journal of Physics D: Applied Physics 38, 2005.
Hans-Juergen Bargel et al., Werkstoffkunde, Verlag des Vereins Deutscher Ingenieure, 1988, pp. 26 to 35.

* cited by examiner

DC GAS DISCHARGE LAMP HAVING A THORIUM-FREE CATHODE

CROSS-REFERENCE TO RELATED APPLICATION

This application claims priority to German Patent Application Serial No. 10 2015 218 878.7, which was filed Sep. 30, 2015, and is incorporated herein by reference in its entirety.

TECHNICAL FIELD

Various embodiments relate generally to a DC gas discharge lamp.

BACKGROUND

The cathodes of DC gas discharge lamps (e.g. mercury discharge lamps, xenon discharge lamps) are generally doped in order to reduce the work function thereof and thus to obtain a lower operating temperature of the cathode. For this purpose, as standard, use is made of $ThO_2$ as emitter material, which is distinguished by a particularly high vaporization temperature. Substitutes (e.g. oxides of lanthanides and/or further oxides, e.g. $ZrO_2$, $HfO_2$) can now reduce the work function of W to a comparable extent; see e.g. Manabu Tanaka et al. 2005 J. Phys. D: Appl. Phys. 38 29 (2005). Accordingly, tip temperatures of approximately 3400 K can be achieved e.g. by addition of 2% by weight $La_2O_3$. In the context of said study, the values—shown in the table below—of the temperature of the tip of a tungsten electrode during the operation of a freely burning argon arc were determined experimentally using a pyrometry method with a continuous wavelength. In this case, the arc length was 5 mm, the protective gas was argon, and the cone angle of the cathode was 60°. The electrode material is indicated in the first column, and the temperature of the cathode tip in kelvins is respectively indicated in the second and third columns for a cathode current of 100 A and for a cathode current of 200 A.

| Electrode material | Temperature [K] (100 A) | Temperature [K] (200 A) |
|---|---|---|
| Pure tungsten | 4062 | 4560 |
| W-2% $ThO_2$ | 3695 | 3723 |
| W-2% $La_2O_3$ | 3352 | 3481 |

However, all the substitutes have a melting point that is hundreds of kelvins lower, such that the emitter evaporates to a much greater extent during operation. This is illustrated in the table below, which lists the melting points of some oxides. The enthalpies of vaporization and the melting points of the associated elements are also generally lower than in the case of thorium, but only a very small part of the emitter is present in elemental form, for which reason the melting points of the compounds are more meaningful.

| | Enthalpy of vaporization [kJ mol$^{-1}$] | Melting point [K] | Boiling point [K] |
|---|---|---|---|
| Cerium | 319 | 1068 | 3716 |
| $Ce_2O_3$ | | 2503 | |
| Hafnium | 661 | 2506 | 4876 |

-continued

| | Enthalpy of vaporization [kJ mol$^{-1}$] | Melting point [K] | Boiling point [K] |
|---|---|---|---|
| $HfO_2$ | | 3047 | |
| Lanthanum | 400 | 1193 | 3737 |
| $La_2O_3$ | | 2578 | |
| Neodymium | 284 | 1297 | 3373 |
| $Nd_2O_3$ | | 2593 | |
| Samarium | 192 | 1345 | 2076 |
| $Sm_2O_3$ | | 2608 | |
| Scandium | 305 | 1814 | 3103 |
| $Sc_2O_3$ | | 2758 | |
| Thorium | 544 | 2115 | 5061 |
| $ThO_2$ | | 3363 | |
| Zirconium | 582 | 2128 | 4682 |
| $ZrO_2$ | | 2950 | |
| Tungsten | 423 | 3680 | |

The fact that emitters not containing thorium evaporate more readily leads, inter alia, to severe bulb blackening and a shorter lamp lifetime. Owing to this poorer performance, cathodes including Th substitutes have not yet been able to gain acceptance, even though they would be preferable for environmental protection reasons.

Unthoriated cathodes have not yet gained acceptance in the lamp sector. Although alternatives to thorium oxide are described in many instances in the patent literature (e.g. addition of oxides of La, Nd, Sm, Zr), three different problems occur in the case of these cathodes.

(1) The emitter transport to the tip is generally not constant owing to the higher emitter evaporation at the tip. The following process takes place (periodically): emitter evaporates at the cathode tip, owing to the lower vaporization temperature of thorium substitutes. The tip temperature rises as a result of the emitter depletion. It is finally so high that emitter from the volume material, the so-called bulk, is transported to the tip again. The temperature falls and the subsequent transport comes to a standstill. The emitter vaporizes, the tip is depleted, the temperature rises, etc. As a result of this process, the work function at the tip is permanently altered, and lamp flicker occurs. This flicker is manifested in both voltage and intensity changes as a result of e.g. arc contraction or altered arc attachment regions. As a result, the cathode becomes unusable for most applications (semiconductor exposure, cinema).

(2) As a result of the flicker and/or as a result of a generally lower deformation temperature, enlargement of the tip and thus loss of intensity occur.

(3) If lamps are actually successfully operated without flicker, the emitter subsequent transport is generally so rapid that the lamps undergo extreme blackening. Use of said lamps is not expedient owing to the thus greatly shortened lifetime.

In this context, EP 1 481 418 B8 discloses a DC gas discharge lamp having a discharge vessel having two necks fitted diametrically oppositely, into which an anode and a cathode each composed of tungsten are fused in a gas-tight fashion, said discharge vessel having a filling composed of at least one noble gas and possibly mercury. At least the material of the cathode tip contains, in addition to the tungsten, lanthanum oxide $La_2O_3$, and at least one further oxide from the group hafnium oxide $HfO_2$ and zirconium oxide $ZrO_2$.

WO 2014/038423 A1 discloses a short-arc discharge lamp containing a rare earth oxide as an emitter substance in a cathode of a fluorescent tube in which a structure is provided in which the rare earth oxide as emitter substance can be protected from evaporating excessively from the cathode and its premature exhaustion can therefore be prevented. A cathode includes a cathode body and a cathode tip connected to the tip of the cathode body, wherein the cathode body includes tungsten which contains a rare earth oxide as emitter substance, and the cathode tip comprises tungsten which does not contain any emitter substance.

WO 2013/113049 A1 describes an electrode of a high-pressure gas discharge lamp which includes a core composed of tungsten or tungsten doped with potassium having a diameter $d_i$ and a shell adjacent thereto having an external diameter $d_a$, wherein the shell, at least in some regions, consists of a particle composite material including a matrix of tungsten and the following condition is met: $d_i \leq d_a/3$. The electrode described therein is said to be distinguished by a significantly reduced arc instability.

Hitherto it has not been possible to show how all three problems, namely flicker (arc instability), electrode burn-back or deformation and blackening of the lamp bulb, can be solved together.

SUMMARY

A DC gas discharge lamp includes an anode and a cathode having a first cathode segment, which forms the surface of the cathode at least in a region of the cathode which faces the anode and has an arc attachment region, within which an arc burning between the cathode and the anode attaches during lamp operation as intended. The first cathode segment consists of tungsten with at least one emitter material for reducing the work function of electrons from the cathode. The cathode is embodied in a manner free of thorium. The at least one emitter material has a melting point of less than 3200 K. At least one part of the surface of the cathode outside the arc attachment region is formed by a diffusion barrier for the at least one emitter material.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
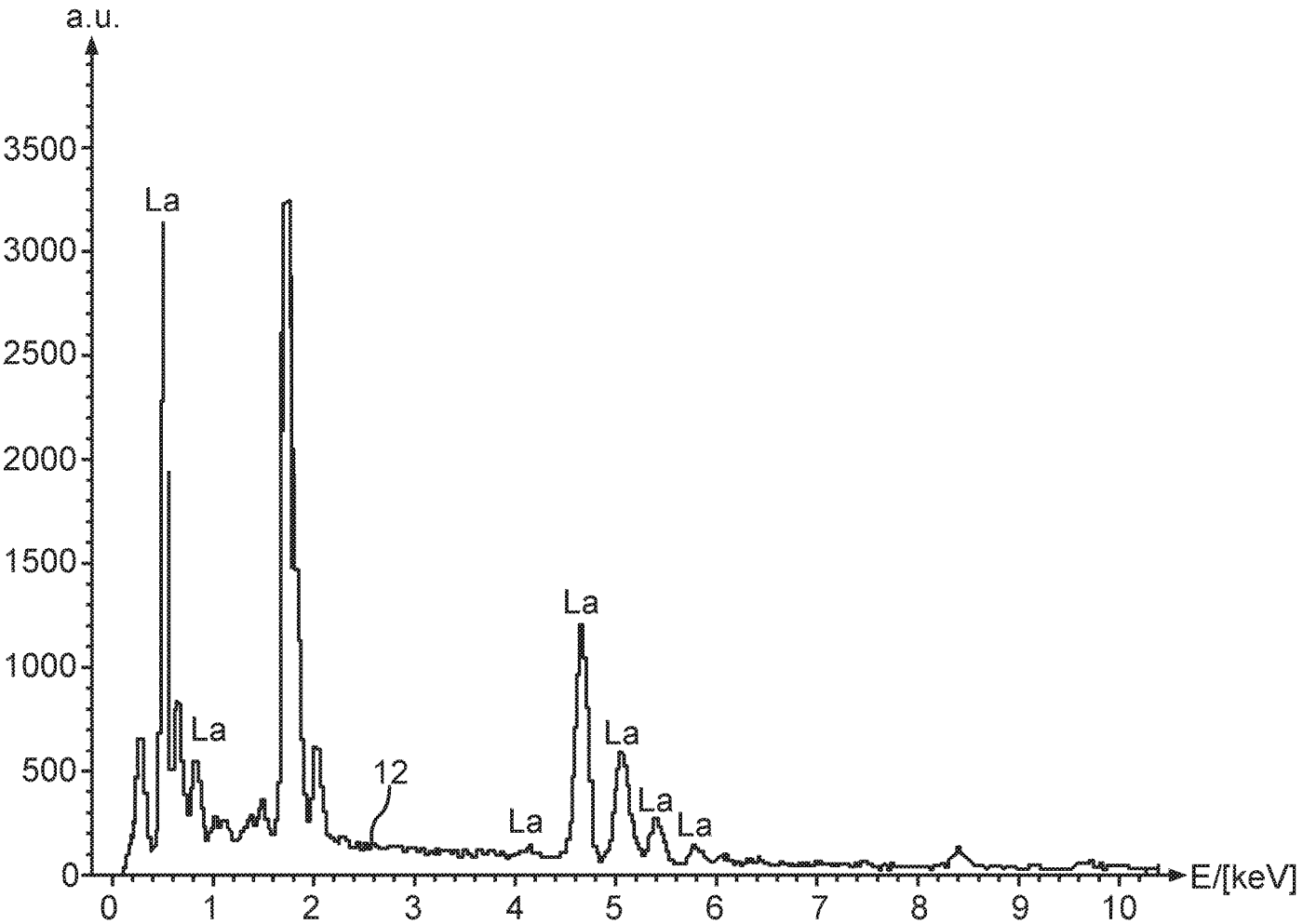
FIG. 1 shows, in a simplified schematic illustration, a diagram—determined by means of EDX—of the analysis of the bulb deposit of a 4 kW lamp.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The features and feature combinations mentioned in the description above and the features and feature combinations mentioned below in the description of the figures and/or shown solely in the figures can be used not only in the combination respectively indicated, but also in other combinations or by themselves, without departing from the scope of the invention. Consequently, embodiments which are not explicitly shown or elucidated in the figures but emerge and are producible by separate feature combinations from the embodiments elucidated should also be considered to be part of the invention and disclosed.

Various embodiments provide a DC gas discharge lamp including a thorium-free cathode which, with regard to lamp lifetime and arc stability, exhibits a behavior comparable to a DC gas discharge lamp equipped with a thoriated cathode.

Various embodiments illustratively proceed from a DC gas discharge lamp, including an anode and a cathode including a first cathode segment, which forms the surface of the cathode at least in a region of the cathode which faces the anode and has an arc attachment region, within which an arc burning between the cathode and the anode attaches during lamp operation as intended. In this case, the first cathode segment consists of tungsten with at least one emitter material for reducing the work function of electrons from the cathode. The cathode is embodied in a manner free of thorium, and the at least one emitter material has a melting point of less than 3200 K, e.g. less than 3100 K. In various embodiments, a DC high-pressure discharge lamp is involved in which, during lamp operation as intended, electrons emerge from the cathode and into the anode after passing through the arc plasma.

According to various embodiments, a DC gas discharge lamp of the generic type is developed in such a way that at least one part of the surface of the cathode outside the arc attachment region is formed by a diffusion barrier for the at least one emitter material.

In this case, it may be provided that the first cathode segment is the sole emitter-containing component of the cathode. In various embodiments, the first cathode segment exposed at the surface of the cathode may include a cathode tip. Furthermore, it may be provided that, apart from tungsten, no constituent of the cathode has a melting point higher than 3100 K. A material used for the diffusion barrier may here have, relative to the tungsten with the at least one emitter material incorporated, a significantly reduced mobility of the emitter material within the diffusion barrier, e.g. a substantial impenetrability.

It may be provided that the first cathode segment is produced in an integral fashion from a tungsten-emitter material mixture, and the first cathode segment is enclosed by the diffusion barrier in a ring-shaped fashion at least in a covering region.

The covering region may extend over a predefinable covering length in an axial direction of the cathode that is given by a connecting line between anode and cathode, e.g. between a tip of the anode and a tip of the cathode. In various embodiments, the covering length may be at least 20% of the length of the cathode in an axial direction, e.g. at least 50%. Furthermore, it may be provided that the cathode includes no compounds whose melting point is below 2300 K.

In various embodiments, it may be provided that the first cathode segment, within a partial section extending in an axial direction of the cathode, is surrounded by the diffusion barrier in a ring-shaped fashion in a radial direction, e.g. that the diffusion barrier in the partial section is arranged as a closed ring around the first cathode segment. It may likewise also be provided that the diffusion barrier has interruptions in a tangential direction, i.e. along the circumference, such that in these interrupted regions within the partial section the first cathode segment is exposed at the surface of the cathode. The partial section may be identical to the covering region. However, it may also be provided that the partial section constitutes only a part of the covering region.

The emitter material is usually introduced in the form of one emitter oxide or a plurality of emitter oxides. The emitter oxides added are present in tungsten composite materials generally in the form of agglomerates. These are situated in the tungsten crystallites and also between the grain boundaries thereof. It can be assumed that e.g. the particles in the grain boundaries are mobile and contribute to the emitter transport through the cathode. In this case, it is supposed that the diffusion here does not take place at an atomic or molecular level, but rather as a particle composite. In this case, the emitter compounds diffuse particularly well above their melting point. The covered area is crucial for the quality of the diffusion barrier.

On the basis of the explanations given above, covering the cathode with a material which constitutes a great diffusion barrier for the emitter appears not to be advantageous at first glance since, after all, the emitter transport via the surface is additionally restricted. It is thus endeavored, surprisingly, to achieve precisely the opposite of what is proposed in the literature (decreasing, instead of increasing, the emitter transport). Rather, the covering proposed here has similarity with the embodiments for cooling anodes; see, for example, DE 10 2009 021 235 A1. However, there the evaporation (substantially of tungsten in this case) takes place at the tip and this is the major difference with respect to the discovery described here. For contrary to expectations, the lateral surface and the cone (minus tip region) principally contribute to the blackening in the case of the thorium-free cathodes used here. This will be clarified by the following appraisal and associated experimental verification in an experiment:

The example considered will be a cathode such as is used e.g. for a 3.5 kW HBO lamp (mercury short-arc lamps). In the case of such cathodes, the tip temperature varies in the region of 3300 K. In the cone the temperature decreases exponentially, such that only 2300 to 2500 K is measured at a distance of 3 mm from the tip. Over the rest of the cone toward the lateral surface region, the temperature decreases further and is finally only 1500 K. The region of the tip as far as the distance of 3 mm behind said tip shall be designated, then, as the tip region, and the rest of the cathode shall be the lateral surface region. The following average temperatures can be assumed for simplification: 2800 K in the tip region and 2000 K in the lateral surface region. The surface area of the tip region is then about 1/20 of the lateral surface area. However, the average vapor pressure in this rear region is at least 900 times lower than in the tip region (calculation according to the Clausius-Clapeyron equation). The expectation would thus be that the tip contributes to the blackening of the lamp 40 times more than the area of cone and lateral surface at the distance of 3 mm from the tip. It is observed, by contrast, that a covering of the lateral surface region with e.g. a ceramic layer, for example a mixture of tungsten and zirconium oxide, greatly reduces the blackening. Contrary to the expectation, a covering of the lateral surface can thus prevent a bulb blackening to the greatest possible extent.

In various embodiments, the cathode has a surface shape which is formed or approximated by the lateral surface of a cylinder and by the lateral surface of a truncated cone and the top surface of the truncated cone. The cathode surface within the covering region at least partly includes the lateral surface of the cylinder and/or the lateral surface of the truncated cone.

The lateral surface of the truncated cone is synonymously also referred to as cone; likewise, the top surface of the truncated cone is also synonymously referred to as (cathode) plateau. In various embodiments, a diffusion barrier on the cone near the tip exhibits a high effectiveness because the cathode here reaches a higher temperature, which in turn accelerates the emitter evaporation. It should therefore be assumed that the coating of the cone region already contributes to a significant reduction of the degradation.

In various embodiments, a ring-shaped region of the surface of the cathode around the arc attachment region, which has a width of at least 1 mm, is free of the diffusion barrier. In order to minimize the blackening, the entire lateral surface and cone as far as the tip should actually be covered since, after all, particularly high temperatures are observed in the vicinity of the cathode plateau. In practice this proves to be unfavorable, however. Firstly, the cathode burns back by a few tenths of a millimeter to a few millimeters in the course of the lamp lifetime. A diffusion barrier extending directly as far as the tip would be damaged here. A plateau deformation could occur over the course of the burning duration as a result of the different materials, which generally leads to a lower radiance. Moreover, the diffusion barrier can be damaged upon ignition particularly in the case of coatings, such that bulb deposits originating from the barrier itself occur. For the reasons mentioned, the cone of the cathode should be free of a diffusion barrier at a distance of at least 1 mm from the plateau.

In various embodiments, the emitter material includes at least one of the following elements: lanthanum (La), neodymium (Nd), samarium (Sm), zirconium (Zr), hafnium (Hf), yttrium (Y), cerium (Ce), scandium (Sc). In various embodiments, the at least one element is introduced as oxide into the emitter material. The effectiveness of the diffusion barrier was examined and confirmed particularly in interaction with lanthanum oxide, in part also with addition of zirconium oxide, as emitter material. In various embodiments, apart from these elements indicated, the emitter material includes no further elements with the exception of oxygen (O) and carbon (C). In various embodiments, it may be provided that the emitter material does not contain any alkaline earth metals customarily used, which tend even more toward evaporation on account of the low melting and boiling points.

In various embodiments, it may be provided that the concentration of the emitter material in the region of the first cathode segment is 1.0 to 3.5 percent by weight, preferably 1.0 to 3.0 percent by weight, in particular 1.5 to 3.0 percent by weight.

Furthermore, it may be provided that the cathode additionally includes carbon which is distributed over the volume of the cathode, and/or is applied superficially by carburization of at least one part of the surface of the cathode. In various embodiments, the carbon may be present in the region of the first cathode segment where it can act as a reducing agent for the emitter material (oxide) and can thus facilitate the diffusion thereof in the direction of the tip.

In various embodiments, it may be provided that the emitter material includes further elements apart from oxygen (O) and at least one of the elements lanthanum (La), neodymium (Nd), samarium (Sm), zirconium (Zr), hafnium (Hf), yttrium (Y), cerium (Ce) or scandium (Sc) with a respective concentration of less than 0.1 percent by weight and/or in total less than 0.2 percent by weight. The influence of deposit formation owing to the evaporation of additional emitter dopings can be reduced as a result.

In a further advantageous embodiment, the diffusion barrier is formed by a coating with a layer thickness of at least 0.2 μm, preferably at least 1 μm, said coating being applied on the surface of the cathode, wherein the coating includes a metal and/or at least one metal compound. A zirconium oxide-tungsten coating and a tungsten coating, each having a thickness of approximately 1 μm, which were produced by sintering, were tested in the context of the invention. Complete impermeability with respect to the emitter is not required for the effectiveness of the layer as a diffusion barrier. In this regard, in the case of a lamp embodied in this way, it was possible to detect lanthanum in very small quantities on the outer side of the coating at the end of the lifetime. Nevertheless, these coatings considerably reduced the blackening. Other coatings and coating methods, for example PVD (physical vapor deposition), are deemed likewise to be effective. It should be expected that a lower porosity has an advantageous effect on the property as a diffusion barrier. There is no upper limit for the layer thickness with regard to the effectiveness. However, thicker layers exhibit disadvantages in the production time (in the case of PVD) and the adhesion (PVD and matrix composite coating), such that thicknesses of greater than 1 mm appear not to be expedient in practice.

In various embodiments, the coating can be designed to bring about a higher emission in the infrared spectral range than tungsten and/or than tungsten with the at least one emitter material during the operation of the cathode. An improved dissipation of heat from the cathode can be realized as a result.

In various embodiments, analogous to DE 10 2009 021 235 A1, the coating is embodied as a matrix layer composed of a first material, particles composed of a second material being incorporated in said matrix layer. The extinction coefficient of the first material in the spectral range of between 600 nm and 2000 nm is less than 0.1 and the extinction coefficient of the second material in the spectral range of between 600 nm and 2000 nm is greater than 0.1. In optics the extinction coefficient (k) denotes the imaginary part of the complex refractive index. It is a dimensionless quantity for the attenuation capability of a medium. The greater said extinction coefficient, the greater the extent to which the incident electromagnetic wave, for example light, is taken up (absorbed) by the material. The extinction coefficient (k) is linked with the absorption index (κ) by way of the real part of the complex refractive index. A coating that reduces the cathode temperature reduces both the emitter transport to the cathode surface and the evaporation.

In various embodiments, the coating includes at least one of the following compounds: zirconium oxide ($ZrO_2$), aluminum nitride (AlN), magnesium fluoride ($MgF_2$), silicon carbide (SiC).

In various embodiments, it may be provided that at least one further coating is applied on the surface of the cathode. In other words, the coating of the cathode is thus embodied in a bipartite fashion. It may be provided, for example, to use in the region of the cathode tip a coating which is insensitive to an incorrect arc attachment, while the best possible heat emission is required in another region. This is used e.g. in the case of lamps having a high mercury density, for example greater than 8 milligrams per cubic centimeter (>8 $mg/cm^3$), since in the case of a restart here with increasing lifetime the arc often does not attach on the cathode plateau or does not remain there.

A further embodiment of a gas discharge lamp includes a second cathode segment composed of an emitter-free material as diffusion barrier, which forms the surface of the cathode at least in the covering region. The first cathode segment is pressed in the second cathode segment. In various embodiments, the first cathode segment is embodied as an inlay in the tip region of the cathode and is embedded in the second cathode segment, such that only a region of the inlay near the tip is exposed at the surface of the cathode. In this case, the second cathode segment can be embodied as a ring-shaped envelope in a partial region of the cathode extending in an axial direction of the cathode, which encloses the first cathode segment. The envelope extends as far as the surface of the cathode in a radial direction at least within the covering region. A particularly simple manner of producing the cathode is possible as a result, since a complex connection between the first cathode segment and the second cathode segment can be dispensed with. Between the first cathode segment and the second cathode segment there is an interface characterized by an increased diffusion rate. An improved emitter transport in comparison with a sintered material is thus observed in this case.

In various embodiments, the cathode includes a second cathode segment composed of an emitter-free material as diffusion barrier, which forms the surface of the cathode at least in the covering region. The first cathode segment is mounted in the second cathode segment. The connection between the second cathode segment and the first cathode segment is produced by means of a sintering process. Particularly preferably, the first cathode segment extends over the entire length of the cathode in an axial direction. Such a construction of the first cathode segment and of the second cathode segment, which construction is coaxial in the case of a rotationally symmetrical arrangement, enables the two cathode segments to be connected stably and reliably. In various embodiments, the cathode can be produced in a simple sintering process. A rotationally symmetrically coaxial construction is not necessary in this case; the first cathode segment can likewise be arranged eccentrically within the second cathode segment.

Provision may also be made for combining both a second cathode segment as diffusion barrier in the form of an envelope surrounding the first cathode segment in a ring-shaped fashion at least over a predefinable length, and a coating to be applied separately of the order of magnitude of a few micrometers to a maximum of one millimeter, in order to improve the operating behavior of the gas discharge lamp even further.

In various embodiments, the gas discharge lamp includes a mercury-containing filling, wherein the product of current density in amperes per square centimeter and mercury density in grams per cubic centimeter is at least 40.0. In the cases in which the product of mercury density ($d_{Hg}$) and current density (j) at the cathode plateau (top surface of the truncated cone/cone) is greater than 40, the diffusion barrier proves to be particularly effective. The blackening can be greatly reduced here, which is explained below in the explanation of exemplary embodiments with associated measurements. In this case, the underlying current density (j) results from a lamp current during operation with nominal power for which the lamp is dimensioned, relative to the exit area of the arc from the cathode, in accordance with the customary cathode shape configuration, that is to say relative to the cathode plateau. The range is expressed as a formula as follows:

$$j \cdot d_{Hg} \geq 40.0 \frac{A \cdot g}{cm^5}.$$

The general mode of operation and the cause of blackening are explained briefly below. The work function at the cathode tip is reduced by the emitter (e.g. lanthanides). In this case, the temperatures at the tip are so high that a part of the emitter also vaporizes. The concentration gradient that arises as a result has the effect that emitter is subsequently supplied from the rear part of the cathode, specifically (a) by diffusion through the bulk, (b) by diffusion along the grain boundaries and (c) by surface diffusion.

Regarding the question of which of these processes is the fastest and thus has the greatest significance for the behavior of the cathode, the literature includes different, partly contradictory statements. In this regard, in measurements for thorium in tungsten it has been found that the rate of surface diffusion is significantly greater than that of grain boundary diffusion. The latter in turn is greater than the rate of volume or bulk diffusion; see e.g. "Bargel, H. J.; Schulze, G.: Werkstoffkunde [Materials Science]; VDI-Verlag GmbH, Düsseldorf, 5th edition (1988)". In WO 2015/128754 A1, by contrast, it is assumed that (at least for yttrium in tungsten) the diffusion takes place principally along the grain boundaries.

The present work has now made it possible to show that there are diffusion processes via the surface which are of crucial importance for the behavior of the cathode. Specifically, the temperature of the cathode is so high that some of the emitter atoms diffusing via the cathode surface evaporate and deposit on the bulb. Without further measures this leads to considerable bulb blackening, see FIG. 1, and thus—as described above—to a great reduction of the lifetime.

In the case of cathodes subjected to high loading, such as are used in HBO lamps and in XBO lamps (xenon short-arc lamps) used for cinema projection, temperatures occur at which emitter vaporizes both from the lateral surface and from the tip. While Th-containing cathodes exhibit only weak evaporation of Th or $ThO_2$, the evaporation for Th substitutes such as e.g. La, Nd, Sm, Zr, Hf, Y, Ce, Sc is very great on account of the lower vaporization temperature of the emitters (emitter compounds). In general, emitter compounds such as e.g. oxides should be taken into consideration here since the emitters are added as a compound to the tungsten matrix and are present in reduced or elemental form—if at all—only as a very small portion during lamp operation.

FIG. 1 illustrates a diagram in which an energy E of X-ray quanta in kiloelectronvolts (keV) is plotted on the abscissa and a signal intensity depending on the energy E of the X-ray quanta is plotted on the ordinate. In this case, EDX stands for energy dispersive X-ray spectroscopy and is a conventional surface-sensitive measurement method in materials analysis. In this case, the atoms of a sample are excited by an electron beam of uniform energy and then emit X-ray radiation having an energy specific to the respective element, the characteristic X-ray radiation. This radiation provides information about the element composition of the sample. The diagram shows a measurement curve profile 12. The peaks which are characteristic of the element lanthanum are identified by La. It is clearly discernible that the bulb deposit consists almost exclusively of the lanthanum (oxide) used here as emitter. Further peaks should be assigned to the glass substrate.

The aim, for preventing the blackening of the lamp bulb, is to minimize the evaporation of the emitter by ensuring that the emitter can be present only at a small part of the surface, namely near the tip. It is required there in order to reduce the tip temperature, while it is not required in the rear region for lamp operation. Such an emitter distribution is achieved by covering the emitter-containing material. In the simplest embodiment, this is achieved by means of a coating which acts as a diffusion barrier. Likewise, enveloping with a solid, non-emitter-containing layer composed of tungsten, for example, also leads to the desired reduction of the emitter evaporation.

Two examples of lamps in which lanthanum oxide ($La_2O_3$) is predominantly used as emitter will now be shown below. The concentration of $La_2O_3$ at 1.7-2.5% by weight (percent by weight) is high enough here that flicker-free operation is possible over the entire lifetime. An electrically nonconductive coating which has a thickness of approximately 3 μm and the main constituents of which are a metal oxide and tungsten was chosen as the diffusion barrier. The cone region at a distance of 2 mm from the tip was left uncovered in both cases. While one lamp has a nominal power of 8 kW for a current density of 20 A/mm$^2$, the other lamp is operated at 3500 W with a current density of approximately 330 A/mm$^2$.

In both cases the blackening behavior of said lamps can be significantly improved by a coating of the cathode (see FIG. 2 and FIG. 3), such that after 1500 and 1000 h significantly more light (9% points and approximately 20% points) is emitted. Thus, with regard to blackening, the lamps vary in the range of thoriated lamps, but manage without radioactive emitter material.

Figure 2:
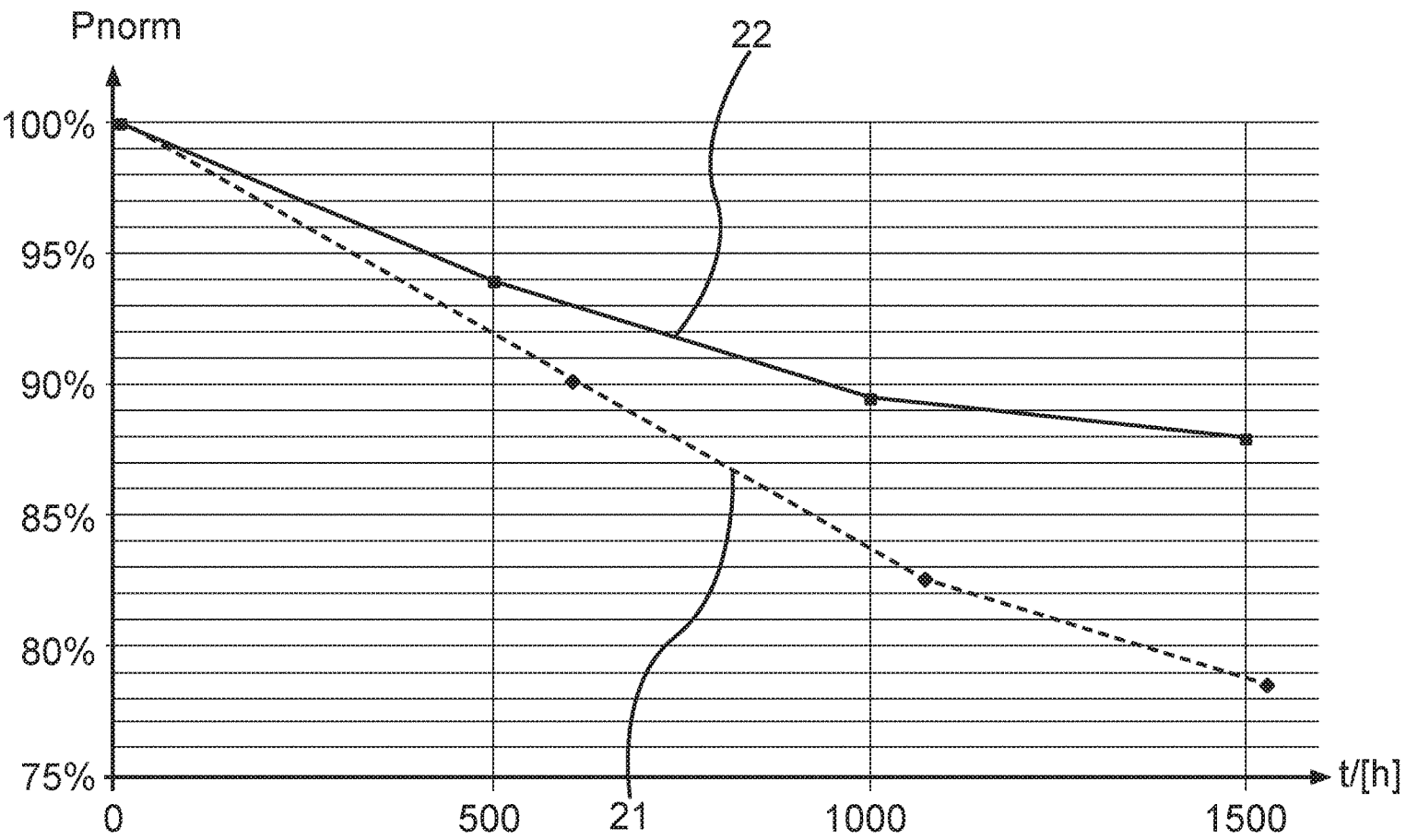
FIG. 2 shows a diagram with the time profile of the radiation power of mercury discharge lamps having a power of 8.0 kW for the comparison of the blackening behavior with and without coating.

The blackening behavior for mercury discharge lamps having a power of 8.0 kW and a current density of approximately 20 A/mm$^2$ can be compared with reference to FIG. 2. In this case, the emitter material of the cathode is based on lanthanum oxide. A burning duration t in hours (h) is plotted on the abscissa; a radiation power relative to the respective initial radiation power of the associated lamp in a wavelength range of between 350 nm and 450 nm is plotted on the ordinate. A first radiation power profile 21 of a first lamp without coating of the cathode and a second radiation power profile 22 of a second lamp with coating are plotted in comparison relative to one another, wherein, on account of the respective normalization to the respective initial radiation power, both radiation power curves 21, 22 start at 100% radiation power with a burning duration t=0. The effect of the coating is clearly discernible in the diagram. After a burning duration of 1500 hours, the second radiation power curve 22 has fallen to 88% of the initial value owing to blackening of the bulb of the mercury discharge lamp, whereas the second lamp without coating of the cathode exhibits a decrease in the radiation power after 1500 burning hours to 79% of the initial value owing to significantly greater blackening.

Figure 3:
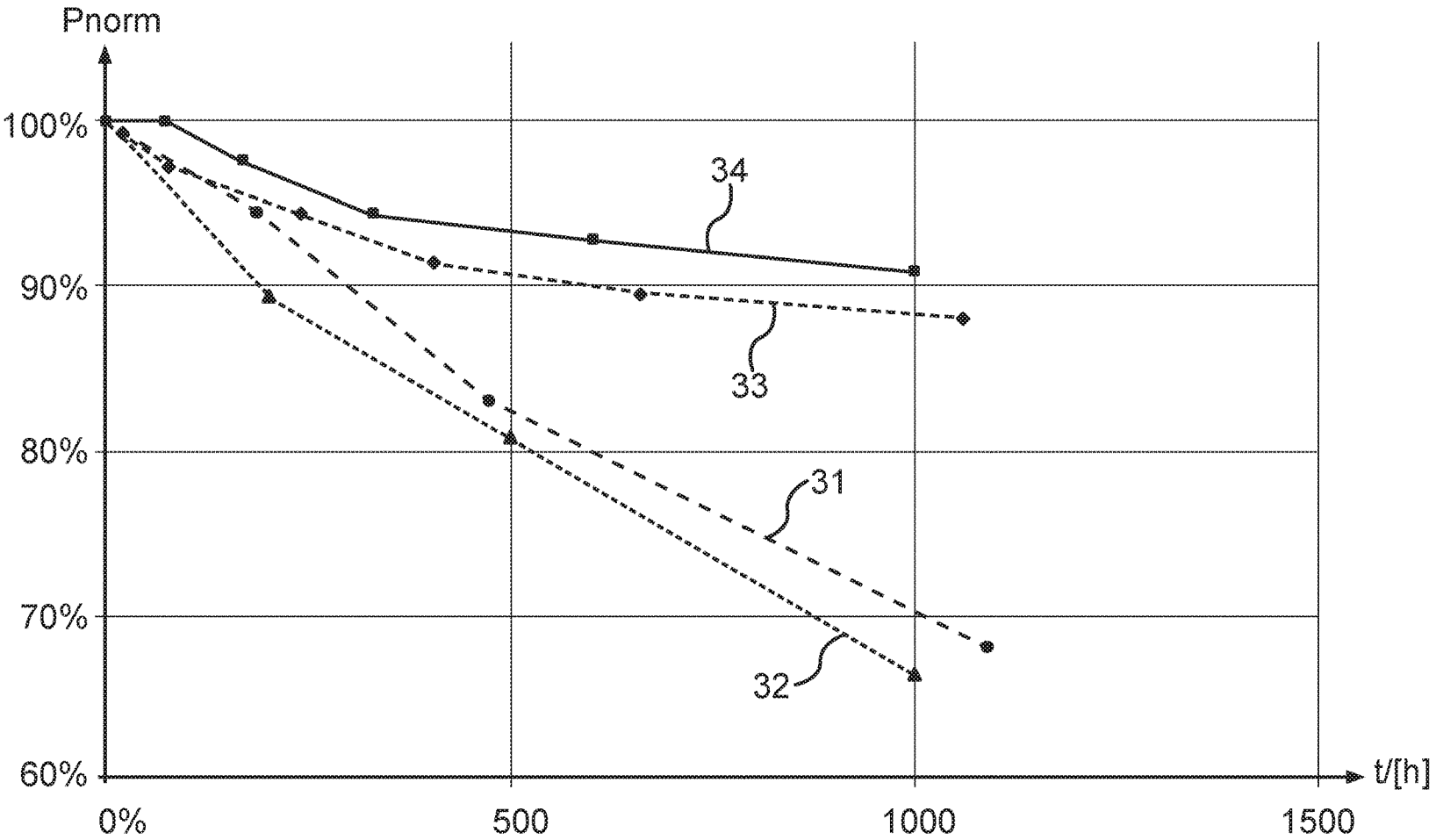
FIG. 3 shows a diagram with the time profile of the radiation power over the burning duration of mercury discharge lamps having a power of 3.5 kW for the comparison of the blackening behavior.

FIG. 3 shows the blackening behavior for mercury discharge lamps having a power of 3.5 kW and an initial current density of approximately 330 A/mm$^2$. The emitter material of the cathode is based on lanthanum oxide. The coating contains zirconium oxide. As already in the illustration in FIG. 2, the burning duration t in hours (h) is plotted on the abscissa and the radiation power, normalized to the respective initial value, in percent is plotted on the ordinate. The illustration shows the respective curve profile for one of four lamps, namely a third curve profile 31 of a third lamp, a fourth curve profile 32 of a fourth lamp, a fifth curve profile 33 of a fifth lamp and a sixth curve profile 34 of a sixth lamp. The third and fourth lamps constitute in each case a specimen of the same design which is embodied without a coating of the cathode, whereas the fifth and sixth lamps are provided in each case by a specimen of a lamp having a coating of the cathode. Consequently, the third and fourth lamps, and the fifth and sixth lamps are in each case structurally identical to one another and differ in their blackening behavior merely as a result of manufacturing tolerances. This is readily discernible in the diagram in accordance with FIG. 3; the third curve profile 31 and the fourth curve profile 34 have a value of 70% and 67%, respectively, of the initial value at a burning duration t of 1000 hours, whereas the fifth curve profile 33 and the sixth curve profile 34 have a radiation power of 91% and 88%, respectively, after the same burning duration t of 1000 hours.

Figure 4:
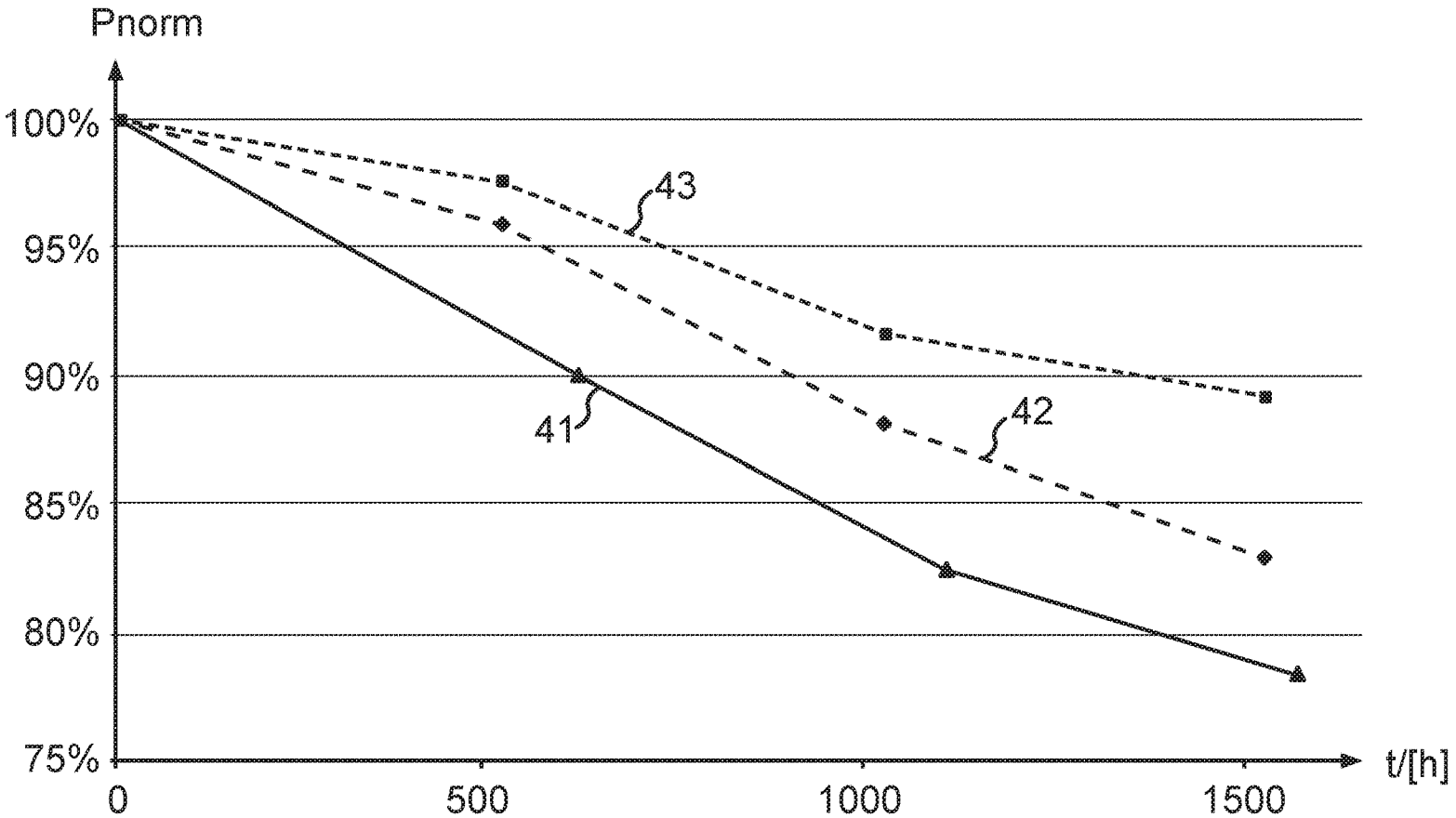
FIG. 4 shows the time profile of the radiation power of 8 kW lamps having diffusion barriers manifested to different extents.

FIG. 4 shows the blackening behavior of three lamps having 8 kW in a comparison, namely a seventh lamp, which has no diffusion barrier, an eighth lamp, which has a cathode covered by a diffusion barrier to the extent of 76%, and a ninth lamp, which has a cathode covered with a diffusion barrier to the extent of 97%. The diffusion barrier was realized here in the form of a coating that begins at the rear end of the cathode. The diagram shows a seventh curve profile 41, representing the behavior of the seventh lamp without a diffusion barrier, an eighth curve profile 42, representing the behavior of the eighth lamp having a diffusion barrier on the lateral surface, and a ninth curve profile 43, representing the behavior of the ninth lamp having a diffusion barrier on the lateral surface and the cone. The least blackening is accordingly exhibited by the ninth lamp having a radiation power of 89% after a burning duration of 1500 hours; after the same burning duration the eighth lamp already exhibits a decrease to 83% of the original radiation power, and the seventh lamp a decrease to approximately 78%.

The covered area is crucial for the quality of the diffusion barrier. This is illustrated on the basis of an example of the three 8 kW lamps. One cathode had no diffusion barrier (seventh lamp), and the other two had a layer as a diffusion barrier, specifically either on the lateral surface (eighth lamp) or on lateral surface and cone (ninth lamp). The greatest degradation was exhibited by the seventh lamp without a diffusion barrier (−22%). In the case of the lamps having a diffusion barrier, the one in which the coated area was greater behaved significantly better. It exhibited a degradation reduced by 5% points (−12% in comparison with −17%). The sum of lateral surface area and cone area will now be designated below by "outer area of the cathode". In that case 76% of the outer area of the cathode was provided with a diffusion barrier in the case of the eighth lamp, and 97% in the case of the ninth lamp. The comparison between the eighth lamp and the ninth lamp shows that the diffusion barrier on the cone near the tip is significantly more effective because the cathode reaches higher temperatures here, which in turn accelerates the emitter evaporation. It can therefore be assumed that the coating of the cone region (here 21% of the area) already contributes to a significant reduction of the degradation.

Both a zirconium oxide ($ZrO_2$)-tungsten coating and a tungsten (W) coating each having a thickness of the layer applied by sintering of approximately 3 μm were tested as diffusion barriers. Complete impermeability with respect to the emitter is not required for the effectiveness of the layer as a diffusion barrier. In this regard, in the case of the fifth lamp, it was possible to detect lanthanum in very small quantities on the outer side of the coating at the end of the lifetime. Nevertheless, these coatings considerably reduced the blackening. Other coatings and coating methods, for example PVD (physical vapor deposition), are deemed likewise to be effective. It is generally expected that a lower porosity has an advantageous effect on the property as a diffusion barrier.

There is no upper limit for the layer thickness with regard to the effectiveness. However, thicker layers exhibit disadvantages in the production time (in the case of PVD) and the adhesion (PVD and matrix composite coating), such that thicknesses of greater than 1 mm appear not to be expedient in practice.

Figure 5:
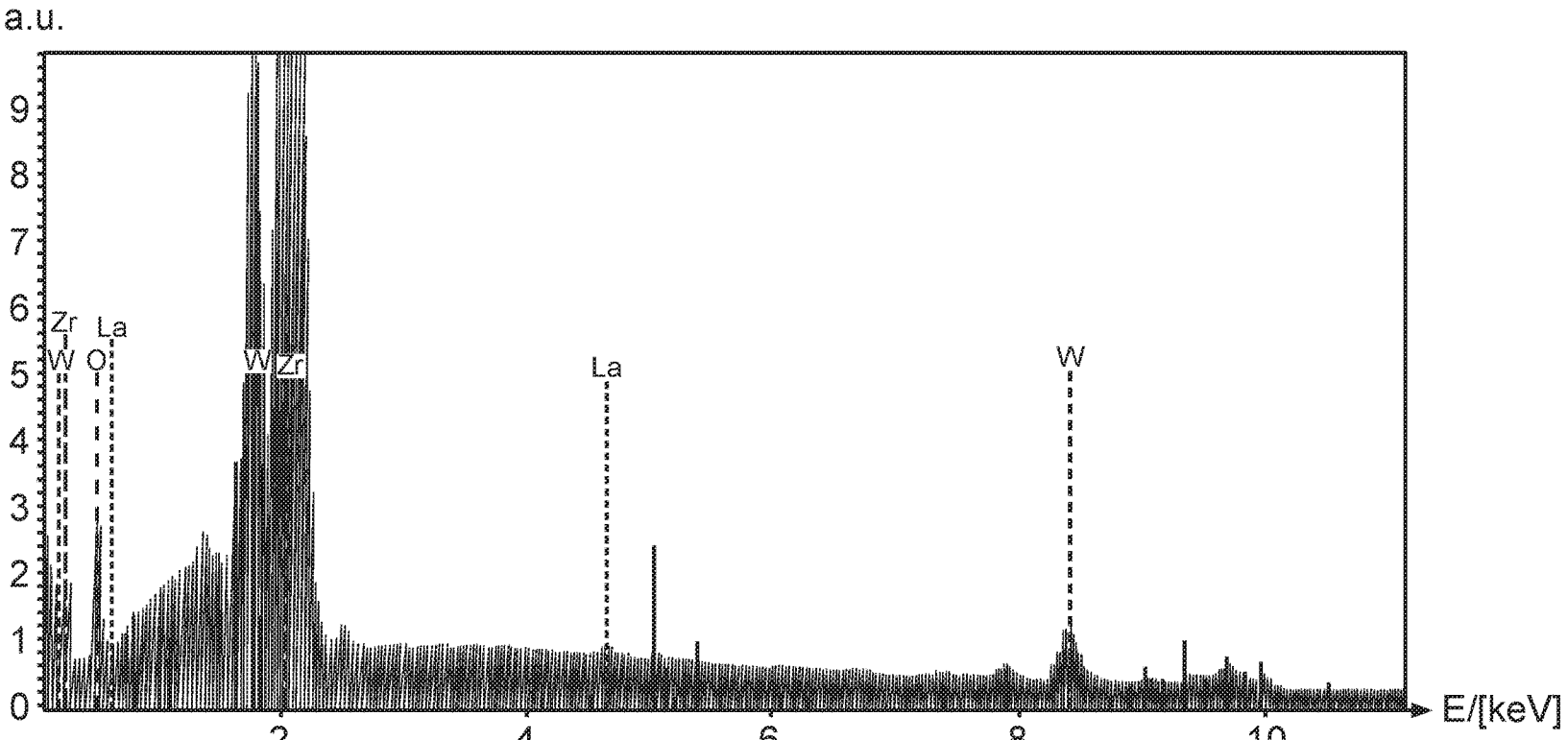
FIG. 5 shows, in a simplified schematic illustration, a diagram—obtained by means of EDX—for the analysis of a coating of a 3.5 kW lamp after a burning duration of 1000 h.

FIG. 5 illustrates an EDX diagram of the coating of the fifth lamp (3.5 kW) at a distance of approximately 7 mm behind the tip. In this case, it was possible to detect lanthanum in very small quantities on the outer side of the coating at the end of the lifetime. The associated characteristic lines of lanthanum are marked in the figure. The ordinate is scaled in the range of 0 to approximately 10. The nonspecific spectrum of the background in the range around 2 keV (energy E of the X-ray quanta) is cut off in the direction of the ordinate and not completely illustrated.

In FIG. 6*a* to FIG. 10 various embodiments of cathodes 100 of DC gas discharge lamps are illustrated below, which in terms of their shaping in various embodiments are formed by a body of revolution including a cylinder 102 and a truncated cone 104, which hereinafter is also referred to as cone.

Reference signs introduced in each case in FIG. 6*a* to FIG. 10, e.g. concerning the dimensionings of the embodiments of the cathodes 100, are introduced only once for the sake of improved clarity and apply to arrangements that are recognizably of the same type, without their being presented explicitly again in the description and/or the respective figure.

Figure 6B:
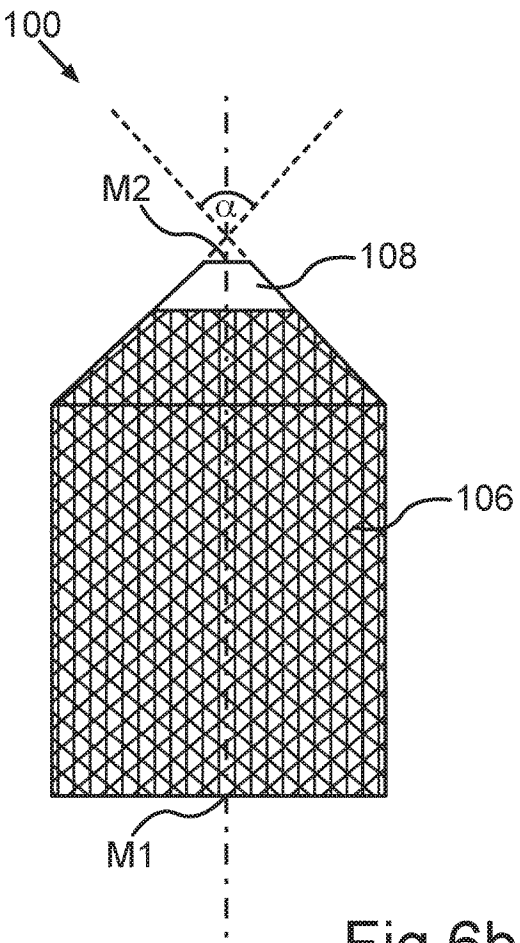
FIG. 6*b* shows, in a simplified schematic illustration, a second embodiment of a cathode of a DC gas discharge lamp according to various embodiments.

The cylinder 102 has a cylinder base surface 102*g* and a cylinder top surface 102*d* with a cylinder diameter d1 and also a lateral surface 102*m* with a cylinder height h1. The truncated cone 104 has a base surface 104*g* with a cone diameter, which may be equal to the cylinder diameter d1, and a top surface 104*d*-also referred to hereinafter as (cathode) plateau—with a plateau diameter d2 and also a lateral surface 104*m*. The truncated cone has a height h2 that characterizes the distance between the base surface 104*g* and the top surface 104*d*. The cylinder base surface 102*g* facing away from the truncated cone 104 is arranged on that side of the cathode 100 which faces away from an anode 200. A cone angle α is defined by the angle of the imaginary tip of the truncated cone 104; the associated opposite angle having the same magnitude is depicted in FIG. 6*b* for the sake of improved illustration.

In accordance with the simplified illustration of the cathodes 100 in FIG. 6*a* to FIG. 10, said cathodes can have a rotationally symmetrical construction, wherein the rotation axis is defined by a first midpoint M1, representing the midpoint of the cylinder base surface 102*g*, and a second midpoint M2, representing the midpoint of the top surface 104*d*. The direction of said axis through the two midpoints M1, M2 is referred to as the axial direction. A direction perpendicular to said axis, which is additionally perpendicular to the lateral surface 102*m*, is referred to as the radial direction. A direction which is perpendicular to said axis and has a common point with the lateral surface 102*m* is referred to as the tangential direction.

As a simplification for elucidating the invention it is assumed that the arc attachment region extends substantially over the extent of the top surface 104*d*, that is to say over the cathode plateau. In this context, near the tip means in direct proximity to the top surface 104*d*.

However, this need not necessarily be the case for cathode shapes which deviate from this basic shape described. Particularly if more complex shapings are present in the region of the cathode plateau, the arc attachment region and the region of geometrical transitions may diverge, for example if the outer contour of the body of revolution can no longer be produced by rectilinear sections, that is to say a polygon which rotates, but rather by curved lines, for example a convex line or a concave line or parts of circle arcs, which may then produce a dome in this case. In such a case the actual arc attachment region should always be taken into account for the arrangement of the diffusion barrier.

Moreover, it may also be provided that the truncated cone 104 is realized by a plurality of truncated cones stepped one above another (not illustrated). A respective base surface 104*g* has a smaller diameter than a respective top surface 104*d* situated underneath (as viewed in the direction of the cylinder 102). Likewise, it may also be provided that the truncated cone 104 is formed by a plurality of truncated cones arranged one above another. The respective diameter of a respective base surface 104*g* is equal to the respective diameter of the top surface 104*d* situated underneath. Each of the respective truncated cones may have an individual cone angle α. In the latter case, a monotonically continuous profile results for the outer contour profile of the composite truncated cone 104 in the axial direction and likewise in the radial direction. By contrast, in the example mentioned previously, the profile of the outer contour line of the composite truncated cone 104 is stepped.

Furthermore, the cathode 100 may have grooves in the form of depressions and/or elevations relative to the basic contour, said grooves being applied in the tangential direction, e.g. in the region of the truncated cone 104. Various embodiments are intended also to encompass configurations of the cathode surface in which there is a structuring in the form of a helical line in the region of the truncated cone 104.

The illustrated shape of the cathode merely represents a basic embodiment of a cathode contour; for example, it may be provided that deviations from the illustrated contour are present preferably in the region of corners and edges, and are formed by additional structures on the surface of the cathode, said structures running e.g. in the tangential direction. In this regard, grooves or webs may be formed, for example, which lower the contour profile below the illustrated outer contour—consisting of the cylinder base surface 102*g*, the lateral surface 102*m*, lateral surface 104*m* (cone) and top surface 104*d* (plateau)—or elevate it beyond the latter. Various embodiments thus also extend to more complex cathode configuration shapes having deviations from the greatly simplified shape of the cylinder 102 and the truncated cone 104 in the radial direction of up to plus/minus 25 percent (+/−25%) of the shape predefined by lateral surface 102*m* and lateral surface 104*m*.

Figure 6A:
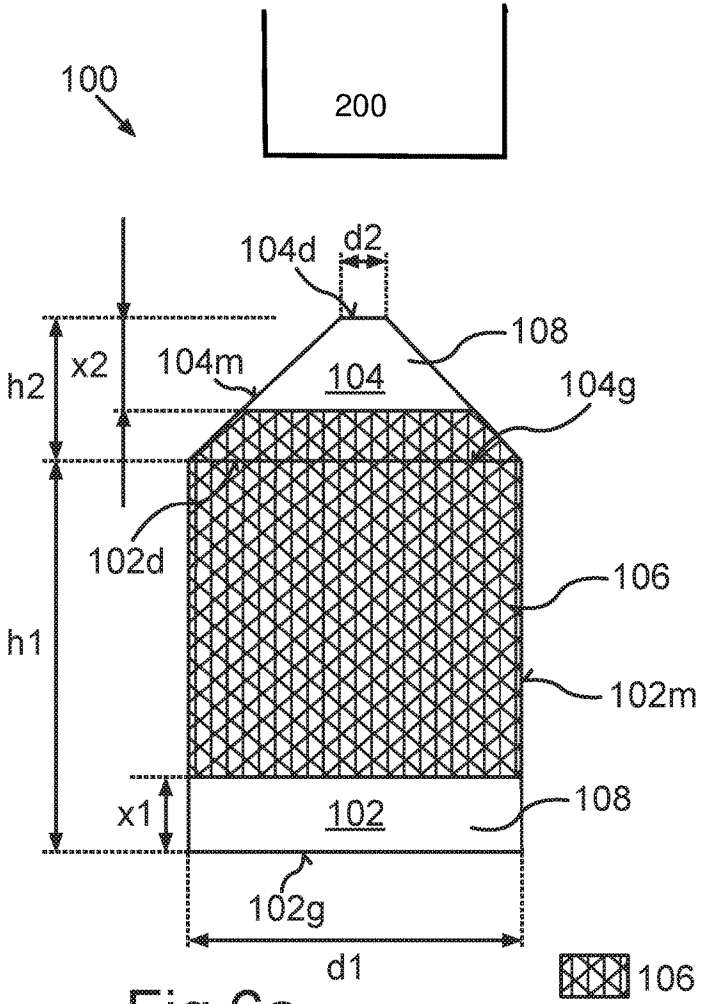
FIG. 6*a* shows, in a simplified schematic illustration, a first embodiment of a cathode of a DC gas discharge lamp according to various embodiments.

With regard to various embodiments in detail:

FIG. 6*a* illustrates a cathode 100 having a diffusion barrier 106 symbolized by a hatched region. In this case, the diffusion barrier 106 proceeding from the base surface 104*g* extends only over a part of the lateral surface 104*m*, such that a part of the truncated cone 104, that is to say of the cone, with a height x2 remains free of the diffusion barrier 106. In the same way, on the side of the cathode facing away from the anode 200, a free strip is provided on the lateral surface 102*m* of the cylinder 102 with a height x1. The diffusion barrier 106 may be present in the form of a coating. The non-hatched surface identifies the part of lateral surface 102*m* and lateral surface 104*m* with emitter-containing tungsten which is exposed at the surface of the cathode. In the hatched region of the diffusion barrier 106, no emitter is present at the surface, but rather for example the coating acting as diffusion barrier 106.

In a second embodiment in accordance with the illustration in FIG. 6*b*, the cathode is completely covered with the diffusion barrier 106 on the entire lateral surface 102*m*, said diffusion barrier furthermore extending over a part of the truncated cone 104, as a result of which a region adjacent to the top surface 104*d* (as viewed in the axial direction) remains free of the diffusion barrier 106.

Figure 7:
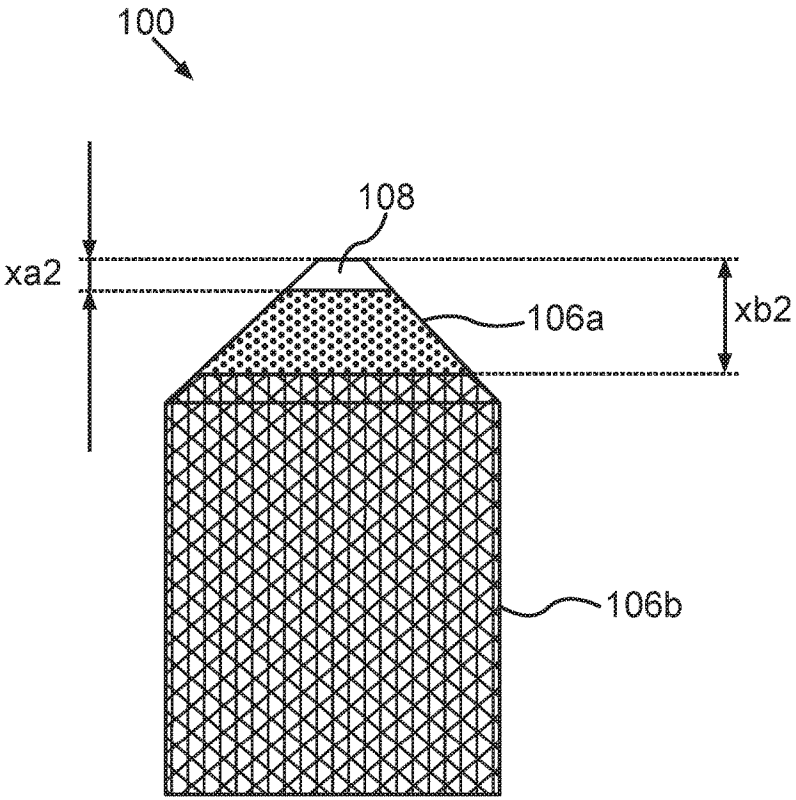
FIG. 7 shows, in a simplified schematic illustration, a third embodiment of a cathode of a DC gas discharge lamp according to various embodiments.

FIG. 7 shows a third embodiment of a cathode 100, in which the diffusion barrier 106 is realized by two different coatings 106*a* and 106*b*. In this case, a first coating 106*a* is arranged on the lateral surface 104*m*, that is to say the cone of the cathode, and thus in direct proximity to an arc attachment region of the arc that burns between the anode and the cathode 100. The arc attachment region is provided at least approximately by the top surface 104*d*. The coating 106*a* may thus be adapted to the higher temperature in direct proximity to the arc attachment point.

The second coating 106*b* can be optimized with regard to other parameters on account of its greater distance from the burning arc. In this case, it may be provided that the first coating 106*a* is applied above the second coating 106*b* and thus at least partly covers the latter. Likewise, it may alternatively be provided that the second coating 106*b* is applied above the first coating 106*a* and at least partly covers the latter. Furthermore, it may be provided that the two coatings 106*a*, 106*b* are each arranged alongside one another on the surface of the cathode with no or only a slight mutual overlap.

Figure 8:
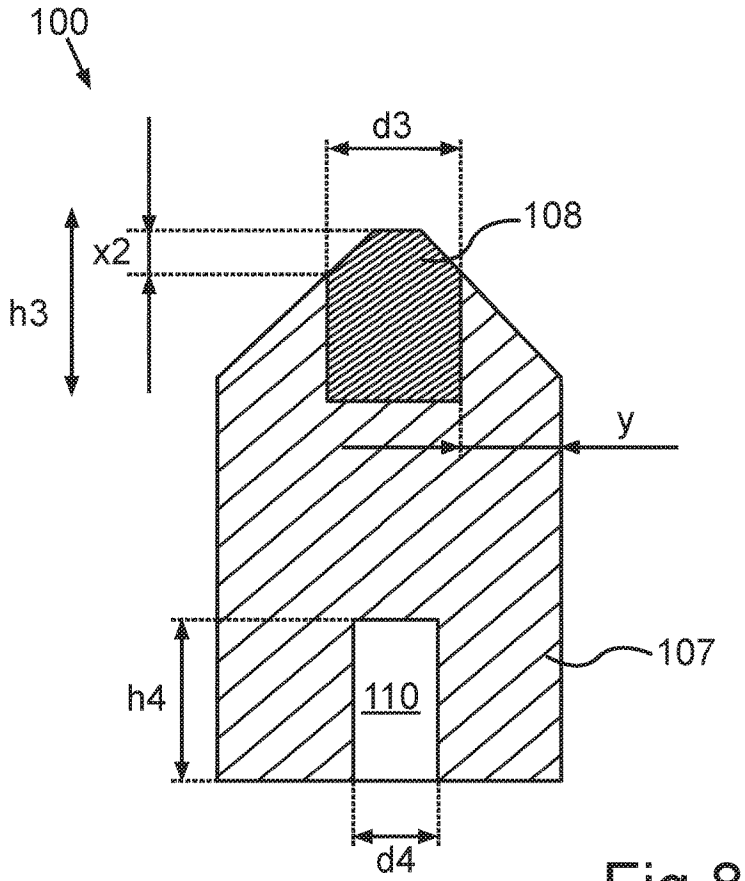
FIG. 8 shows, in a simplified schematic illustration (sectional view), a fourth embodiment of a cathode of a DC gas discharge lamp according to various embodiments.

FIG. 8 illustrates a fourth preferred embodiment of a cathode 100 including a core 108 composed of emitter-containing tungsten, which is pressed in an envelope 107 composed of an emitter-free metal having a high melting point. Said metal may be tungsten. In this embodiment, the emitter-free envelope 107 forms the diffusion barrier. The length y is the smallest distance between core 108 and lateral surface 104*m*. In the fourth embodiment, the emitter-containing core 108, which has a core length h3 proceeding from the top surface 104*d* in the axial direction, is arranged concentrically within the cathode 100, wherein, in the example illustrated, the core length h3 is greater than the height h2 of the truncated cone 104, such that the core 108 extends not only over the complete region of the truncated cone 104 but also into a region of the cylinder 102. It goes without saying that the core length h3 can also be less than the height h2 of the truncated cone 104, such that the core 108 is situated only within the region of the truncated cone 104. Between the emitter-containing core 108 and the surface of the lateral surface 102*m* of the cylinder 102, the smallest distance y thus arises in the radial direction. The core 108 may be pressed as an inlay in the body of the cathode 100.

As a supplementation to the illustrations in FIG. 6*a*, FIG. 6*b* and FIG. 7, a cutout 110 is illustrated, which proceeds from the cylinder base surface 102*g*, having a diameter d4 and a length h4, wherein said cutout 110 is designed to receive a power supply to the cathode 100.

Figure 9:
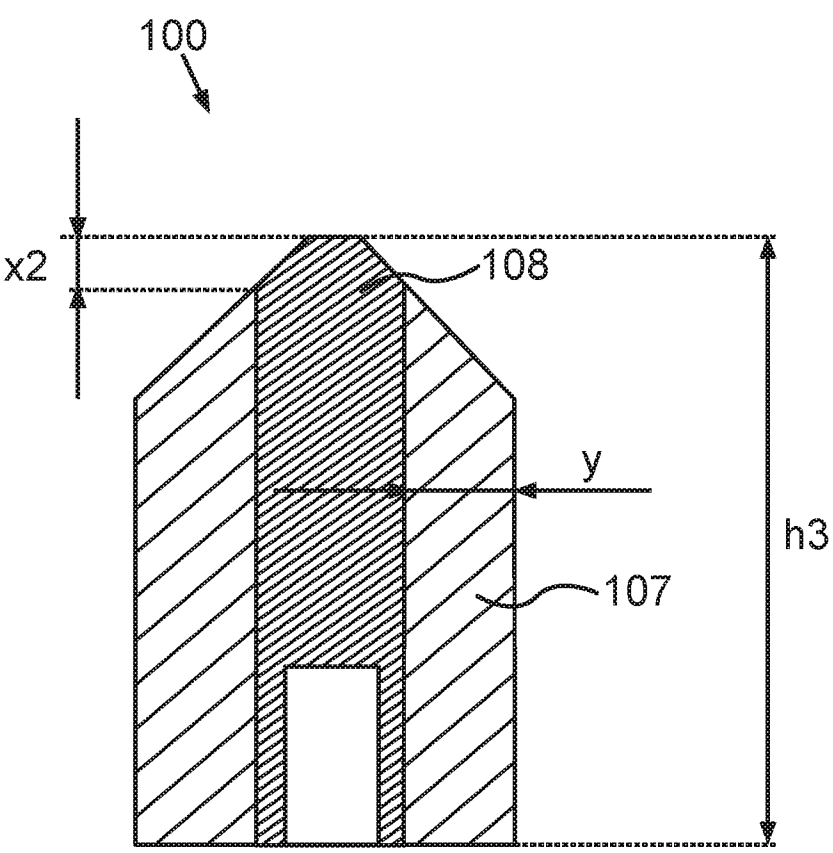
FIG. 9 shows, in a simplified schematic illustration (sectional view), a fifth embodiment of a cathode of a DC gas discharge lamp according to various embodiments.

FIG. 9 shows a fifth embodiment of a cathode 100 including an emitter-containing core 108, which is sintered in an emitter-free envelope 107 composed of a metal having a high melting point, e.g. tungsten. In this case, it may be provided that the emitter-containing core 108 extends in an axial direction over the complete length of the cathode 100, that is to say that the length h3 of the core is equal to the sum of the cylinder height h1 and the truncated cone height h2. In the embodiment illustrated, the diameter d4 of the cutout 110 is less than the diameter d3 of the emitter-containing core 108. However, it may also be provided that the diameter d4 of the cutout 110 is greater than the diameter d3 of the emitter-containing core 108, such that the emitter-containing core 108 is not exposed in the region of the cylinder base surface 102*g* of the cathode.

Figure 10:
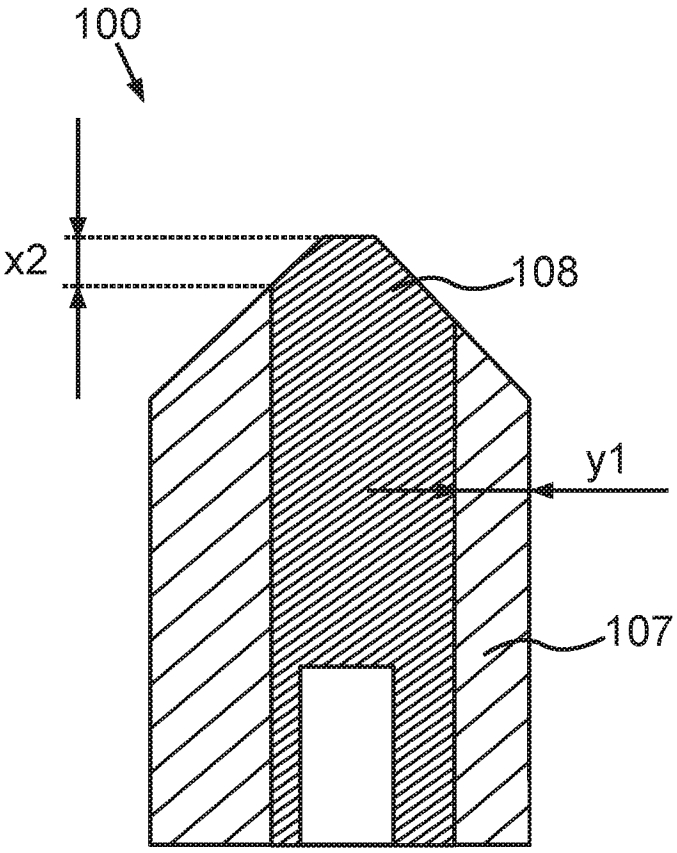
FIG. 10 shows, in a simplified schematic illustration (sectional view), a sixth embodiment of a cathode of a DC gas discharge lamp according to various embodiments.

In a sixth embodiment in accordance with FIG. 10, in contrast to the illustration in FIG. 9, the emitter-containing core 108 is not necessarily arranged coaxially in the cathode 100; rather, it may be provided that the core 108 is arranged asymmetrically in the cathode 100. In various embodiments, the simpler producibility of the cathode 100 may be afforded here.

A reduction of the blackening is illustrated in the table below depending on a product of current density j and mercury density $d_{Hg}$ for a plurality of lamp specimens. In this case, the first column "No." shows the number of the respective lamp, the second column "P" shows the power of the lamp in watts (W), the third column shows the material used in each case for the electrodes, the fourth column "$j*d_{Hg}$" shows the product of current density j (in A/cm$^2$) and mercury density $d_{Hg}$ (in g/cm$^3$) in A·g/cm$^5$, the fifth column "Coating" shows the presence of the diffusion barrier, identified in each case by "X" for present and "–" for absent, and the sixth column "^" shows the improvement of the integrated radiation power of the respective lamp sample by means of a cathode with a diffusion barrier, relative to the embodiment without a diffusion barrier in percentage points.

| No. | P | Material | $j*d_{Hg}$ | Coating | ^ |
|---|---|---|---|---|---|
| 1a | 8000 | A | 118.9 | X | 12.0% |
| 1b | | A | 118.9 | — | |
| 2a | 8000 | A | 166.4 | X | 13.0% |
| 2b | | A | 166.4 | — | |
| 3a | 4300 | A | 124.2 | X | 11.0% |
| 3b | | A | 124.2 | — | |
| 4a | 12 000 | A | 143.4 | X | 15.0% |
| 4b | | A | 143.4 | — | |
| 5a | 3500 | B | 77.1 | X | 21.0% |
| 5b | | B | 77.1 | — | |
| 6a | 3500 | B | 79.2 | X | 22.0% |

-continued

| No. | P | Material | $j*d_{Hg}$ | Coating | ^ |
|---|---|---|---|---|---|
| 6b | | B | 79.2 | — | |
| 7a | 3500 | C | 39.3 | X | 1.0% |
| 7b | | C | 39.3 | — | |
| 8a | 4500 | C | 42.5 | X | 3.0% |
| 8b | | C | 42.5 | — | |

As already explained above, the outer shaping of the cathode may vary, for example by virtue of a rounding of the truncated cone 104 to form a dome and/or a smoothing/grinding of an edge transition at the base surface 104*g*/cylinder top surface 102*d* from the truncated cone 104 to the cylinder 102. Likewise, arbitrary surface structurings may be present, flanks may be embodied as convex or concave and, if appropriate, further gradations, slots, webs or similar structural features may be added, without departing from the basic shape.

The embodiments serve merely for elucidating the invention and are not restrictive for the latter. By way of example, the type and the method of application of the diffusion barrier 106 may be fashioned arbitrarily, without departing from the concept of the embodiments.

It has thus been shown above how a cathode 100 for discharge lamps can be embodied without using thorium.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A DC gas discharge lamp, comprising:

an anode; and a cathode comprising a first cathode segment, which forms the surface of the cathode at least in a region of the cathode which faces the anode and has an arc attachment region, within which an arc burning between the cathode and the anode attaches during lamp operation as intended;

wherein the first cathode segment consists of tungsten with at least one emitter material for reducing the work function of electrons from the cathode;

wherein the cathode is embodied in a manner free of thorium;

wherein the at least one emitter material has a melting point of less than 3200 K; and wherein at least one part of the surface of the cathode outside the arc attachment region is formed by a diffusion barrier for the at least one emitter material;

wherein the diffusion barrier is comprised of a coating applied on the surface of the cathode, wherein the coating comprises at least a first coating arranged in direct proximity to the arc attachment region, and a second coating arranged on the cathode surface at a greater distance from the arc attachment region than the first coating.

2. The discharge lamp of claim 1, wherein the first cathode segment is produced in an integral fashion from a tungsten-emitter material mixture; and wherein the first cathode segment is enclosed by the diffusion barrier in a ring-shaped fashion at least in a covering region.

3. The discharge lamp of claim 1, wherein the cathode has a surface shape which is formed or approximated by the lateral surface of a cylinder and by the lateral surface of a truncated cone and the top surface of the truncated cone;

wherein the cathode surface within the covering region at least partly comprises the lateral surface of the cylinder and/or the lateral surface of the truncated cone.

4. The discharge lamp of claim 1, wherein a ring-shaped region of the surface of the cathode around the arc attachment region, which has a width of at least 1 mm, is free of the diffusion barrier.

5. The discharge lamp of claim 1, wherein the emitter material comprises at least one of the following elements:

La;
Nd;
Sm;
Zr;
Hf;
Y;
Ce;
Sc.

6. The discharge lamp of claim 5, wherein the at least one element is introduced as oxide into the emitter material.

7. The discharge lamp of claim 1, wherein the concentration of the emitter material in the region of the arc attachment region is 1.0 to 3.5 percent by weight.

8. The discharge lamp of claim 7, wherein the concentration of the emitter material in the region of the arc attachment region is 1.0 to 3.0 percent by weight.

9. The discharge lamp of claim 8, wherein the concentration of the emitter material in the region of the arc attachment region is 1.5 to 3.0 percent by weight.

10. The discharge lamp of claim 1, wherein the cathode additionally comprises carbon which at least one of is distributed over the volume of the cathode or is applied superficially by carburization of at least one part of the surface of the cathode.

11. The discharge lamp of claim 1, wherein the coating has a layer thickness of at least 0.2 μm;

wherein the coating comprises at least one of a metal and/or at least one metal compound.

12. The discharge lamp of claim 11, wherein the coating is designed to bring about a higher emission in the infrared spectral range at least one of than tungsten or than tungsten with the at least one emitter material during the operation of the cathode.

13. The discharge lamp of claim 11, wherein the coating is embodied as a matrix layer composed of a first material, particles composed of a second material being incorporated in said matrix layer;

wherein the extinction coefficient of the first material in the spectral range of between 600 nm and 2000 nm is less than 0.1 and the extinction coefficient of the second material in the spectral range of between 600 nm and 2000 nm is greater than 0.1.

14. The discharge lamp of claim 11, wherein the coating comprises at least one of the following compounds:

$ZrO_2$;
AlN;
$MgF_2$; and
SiC.

15. The discharge lamp of claim 1, further comprising:

a second cathode segment composed of an emitter-free material as diffusion barrier, which forms the surface of the cathode at least in the covering region;

wherein the first cathode segment is pressed in the second cathode segment.

16. The discharge lamp of claim 1, further comprising:

a second cathode segment composed of an emitter-free material as diffusion barrier, which forms the surface of the cathode at least in the covering region;

wherein the first cathode segment is mounted in the second cathode segment;

wherein the connection between the second cathode segment and the first cathode segment is produced by means of a sintering process.

17. The discharge lamp of claim 1, wherein the discharge lamp is a mercury discharge lamp;

wherein the product of current density in $A/cm^2$ and mercury density in $g/cm^3$ is at least 40.0.

18. The discharge lamp of claim 1, wherein the first coating at least partially covers the second coating.

19. The discharge lamp of claim 1, wherein the second coating at least partially covers the first coating.

20. The discharge lamp of claim 1 wherein the first and the second coating are arranged alongside one another with no mutual overlap.

* * * * *